United States Patent [19]

Lyu et al.

[11] 4,326,896

[45] Apr. 27, 1982

[54] METHOD OF MAKING TIN-LAYERED STOCK MATERIAL AND CONTAINERS THEREFROM

[75] Inventors: Seung W. Lyu, Homewood; Surya K. Misra, Naperville, both of Ill.

[73] Assignee: National Can Corporation, Chicago, Ill.

[21] Appl. No.: 187,606

[22] Filed: Sep. 15, 1980

[51] Int. Cl.[3] ..... C21D 9/46; C21D 9/48

[52] U.S. Cl. ..... 148/12 D; 148/31.5; 413/18

[58] Field of Search ..... 148/12 D, 31.5, 12 R; 113/120 A, 120 H, 120 F

[56] References Cited

U.S. PATENT DOCUMENTS

| | | | |
|---|---|---|---|
| 1,663,445 | 3/1928 | Davis | 428/648 |
| 2,116,107 | 5/1938 | Erb | 113/120 F |
| 3,087,871 | 4/1963 | Kamm | 204/37 T |
| 3,360,157 | 12/1967 | Bolt et al. | 113/120 A |
| 3,367,751 | 2/1968 | Halley et al. | 75/123 R |
| 3,779,798 | 12/1973 | Clinton et al. | 428/648 |
| 4,033,274 | 7/1977 | Beese | 113/120 A |
| 4,055,272 | 10/1977 | Beese | 113/120 A |
| 4,157,694 | 6/1979 | Nemoto et al. | 113/120 A |

FOREIGN PATENT DOCUMENTS 52-20924 2/1977 Japan ..... 148/12 D

OTHER PUBLICATIONS

*The Making Shaping and Treating of Steel*; 8th Ed.; Chapter 34; pp. 947–973.

Hoare, W. E. et al.; *The Technology of Tinplate*; New York: St. Martin's Press, 1965; pp. 264–306.

*Primary Examiner*—W. Stallard

*Attorney, Agent, or Firm*—Robert A. Stenzel; James W. Ove, Jr.

[57] ABSTRACT

A method of producing stock material wherein a steel base is provided with a layer of tin thereon, the tin-layered steel is then cold rolled and thereafter heated to a temperature above 250° F. but below the melting point of tin; in a second method of producing stock material, the stock is heated above the melting point of tin; also included are methods of producing containers utilizing stock produced by each of said stock producing methods; further included is another method of producing containers wherein a steel base is provided with a layer of tin thereon, heated to a temperature between 250° F. to below the melting point of tin, and thereafter formed into a seamless container.

11 Claims, 5 Drawing Figures

CONVENTIONAL MATTE

CONVENTIONAL BRIGHT

LOW THERMAL TREATMENT

LOW THERMAL AND
MECHANICAL TREATMENT

MECHANICAL AND
REFLOW METHOD

METHOD OF MAKING TIN-LAYERED STOCK MATERIAL AND CONTAINERS THEREFROM

TECHNICAL FIELD

The present invention relates generally to improved tinplated stock material and more particularly to a method for producing an improved tinplated stock material and a method for making containers from said stock material.

BACKGROUND PRIOR ART

This invention relates to a tin coated steel stock material having excellent formability and good corrosion resistance, a method of producing such stock material and a method of producing seamless steel containers from such stock through a drawing and ironing operation.

Various processes are presently being utilized for forming seamless containers from flat blanks. One well-known, common commercial procedure involves first drawing a circular blank into a cup form by forcing the blank through a drawing die by means of a punch mounted on a press. Subsequently, the cup goes through an ironing operation wherein the cup is passed through one or more ironing dies whose inside diameters are progressively slightly smaller than the outside diameter of the cup to form a container body.

In the ironing operation, the sidewall of the cup is elongated by reducing its thickness without reducing the inside diameter of the cup. The ironed body is trimmed to a constant length and then necked in and flanged at its open end. After the container body is filled with product, a closure end is double seamed to the flange to seal the container and its contents. For greater detail, reference is made to an article appearing in the November, 1973 issue of AEROSOL AGE magazine entitled "The drawn and Ironed Can—Understanding the Technology".

Heretofore, two types of tin coated stock material have been used in the commercial production of seamless tinplated containers. One such type is commonly referred to as matte finish and the other as bright finish.

The production of matte finish can stock is well known and that portion of the process which is relevant hereto conventionally involves temper rolling of the steel base to provide a cold reduction of up to approximately 3% in thickness to control the temper of steel base, electroplating a tin coating onto both sides of the steel base, for example, a coating of 0.25 lb/B.B. per side, and drying the tinplated stock normally in the range of 130° F. to 180° F. to remove moisture. While both matte and bright tinplate provide increased formability when compared to steel stock, it is stated in U.S. Pat. No. 3,360,157 that the matte tinplate has an advantage over bright tinplate because it provides better formability. This apparently reduces the problem of fracturing of the metal as it is formed into a can or during later necking and flanging.

Bright finish stock plate is formed generally in the same manner as matte finish stock with the added step of heating the tinplated steel above its melting point to reflow the tin layer and to form an iron-tin alloy layer giving the stock a bright appearance. The melting point of tin is approximately 449° F. to 450° F. depending on the purity of the tin. The reflux heating temperature used by commercial manufactures is generally in the range of 450° F. to 455° F. The alloy layer increases the corrosion resistance of the metal by providing a further protective layer covering the steel base.

While the use of bright stock increases the corrosion resistance of the finished container, bright stock does not exhibit as great an amount of formability as the matte stock. This is believed to occur because the iron-tin alloy layer of the bright stock is of a harder and more brittle nature than the free or non-alloy tin layer, thereby resulting in increased friction between the steel substrate and the dies during the forming and flanging steps.

For beer and beverage containers, the major portion of drawn and ironed container production, matte finish has been widely used because of its superior formability over bright finish stock. While the corrosion resistance is not as good as bright finish, it has been found to be generally adequate for beer and beverage drinks, if organic coatings are later applied and cured.

For sanitary containers used in packaging such products as food, corrosion resistance is of the utmost importance and therefore bright finish can stock is used almost exclusively despite its poorer formability. Due to the poorer formability of bright stock, sanitary containers generally are not commercially formed by drawing and ironing. Instead, the slower and less economical three-piece container manufacturing method is employed. In conventional three-piece production methods, a flat sheet or blank of stock is rolled around a mandrel with the abutting lateral edges permanently being side sealed together, usually by soldering or welding. The open ends of this formed cylindrical container are then necked in and flanged. A bottom end closure is then double seamed thereto, and after product filling, a top end closure is similarly applied.

For the various reasons discussed above, it can be seen that a tinplate can stock which has improved formability and improved corrosion resistance is desirable. U.S. Pat. No. 4,157,694 to Nemoto et al., discloses a method of increasing the formability of tinplate having an iron-tin alloy layer. That reference teaches that an alloy layer formed by flow melting produces a hard and brittle layer. Nemoto et al. also proposes that a very fine structured iron-tin alloy layer of a thickness of 0.005 to 0.2 g./m.$^2$ first be formed electrochemically on the steel substrate and thereafter electroplating a layer of tin over the electrochemically formed tin layer. A potential problem is foreseen with this method in that it represents a significant departure from tinplate stock manufacturing resulting in increased capital expenditure, and possible reluctance by tinplate producers to commercially adopt such a method; therefore, an alternative method is desired.

SUMMARY OF THE INVENTION

According to one aspect of the invention, an improved tinplate stock material is formed by (1) temper rolling the steel base to provide a cold reduction, for example, of up to 3% in thickness; (2) plating a layer of tin on at least one and preferrably both surfaces of the steel base; and (3) heating the tinplated stock between 250° F. to just below the melting point of tin to cause a portion of the plated tin to become a part of an iron-tin alloy layer.

In another aspect of this invention, an improved stock material is formed by; (1) temper rolling the steel base to provide a cold reduction of, for example, up to 2% in thickness; (2) plating a layer of tin on at least one and preferrably both surfaces of the steel base; and (3) rolling the tinplated stock material for a second time to produce, for example, up to a 2% reduction in thickness and thereby provide an increase in the number of high energy nucleation sites for the later forming of a higher quality alloy layer; and (4) heating the stock material to a temperature between 250° F. to just below the melting point of tin to form an alloy layer of fine, uniform and continuous grain structure.

In another aspect of this invention, an improved stock material especially suitable for high corrosion resistance applications is formed by; (1) temper rolling the steel base by providing a cold reduction of, for example, up to 2% in thickness; (2) tinplating a layer of tin on at least one, and preferrably both, sides of the steel base; (3) cold rolling the tinplated stock a second time to provide a reduction of thickness of, for example, 2% for the purpose of increasing the quality of the later formed alloy layer; and (4) heating the stock material to a temperature above the melting point of tin to form an iron-tin alloy layer.

It is an object of this invention to produce a tin-plated stock material with formability better than the formability of conventional matte and bright finish tinplate and also with corrosion resistance better than matte finish tinplate.

It is also an object of this invention to provide such tinplated stock material through a method which results in a minimum of departure from the steps of present commercial production of tinplate stock.

DETAILED DESCRIPTION

The steel base of the stock may vary depending upon the application. For beverage containers, one example of suitable conventional low carbon steel sheet which may be used in the present invention is of thickness of approximately 0.32 mm. having the typical properties indicated below.

| The Composition of the Steel (Maximum Percent by Weight) | |
|---|---|
| C | 0.13 |
| Mn | 0.60 |
| S | 0.05 |
| P | 0.015 |
| Si | 0.02 (0.08 Si maximum for continuous cast) |
| Cu | 0.06 |
| Cr | 0.06 |
| Fe | balance |
| Al | 0.03 to .1 |
| Others | 0.02 each |

| The Mechanical Properties of the Steel | |
|---|---|
| Ultimate tensile stress | 45.3–47.4 Ksi. |
| Yield strength | 32.4–33.3 Ksi. |
| Tensile elongation | 36.5–38.5% in 2" |
| Hardness | 50–53 R.30-T |

It will be understood that the above are average composition and property values and may vary slightly from melt to melt. Other compositions of steel may also be used without departing from the spirit and scope of the invention, the above steel being used as an example only.

Figure 1:
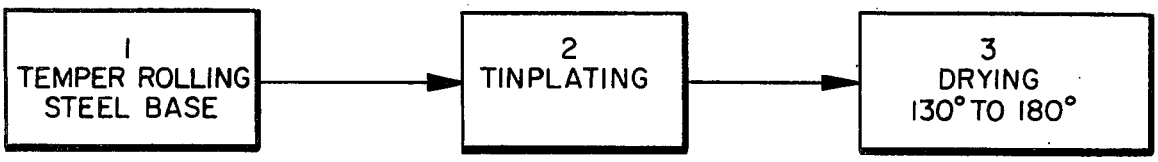
FIG. 1 (PRIOR ART)
FIG. 1 is a flow diagram of the steps for conventional production of matte finish tinplate stock.
Figure 2:
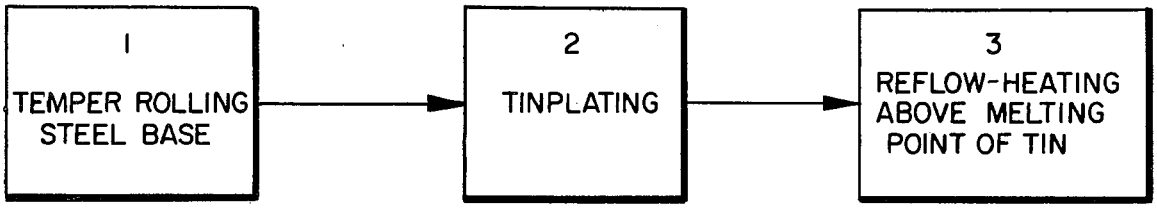
FIG. 2 (PRIOR ART)
FIG. 2 is a flow diagram of the steps for conventional production of bright finish tinplated stock.
Figure 3:
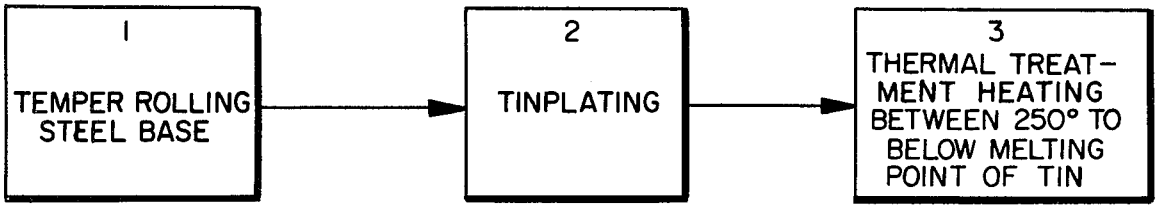
FIG. 3 is a flow diagram of the steps for producing an improved tinplated stock material by a low thermal method.
Figure 4:
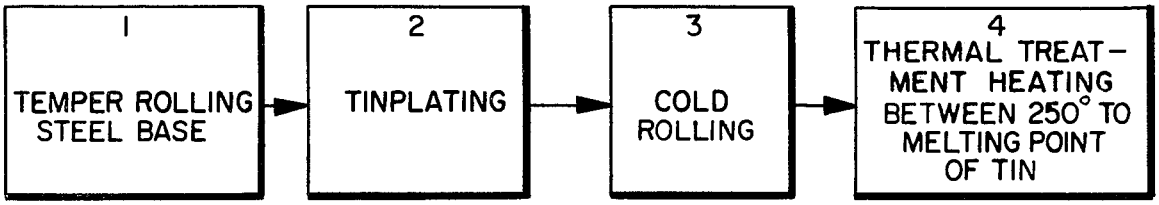
FIG. 4 is a flow diagram of the steps for producing an improved tinplated stock material by a low thermal and mechanical method.
Figure 5:
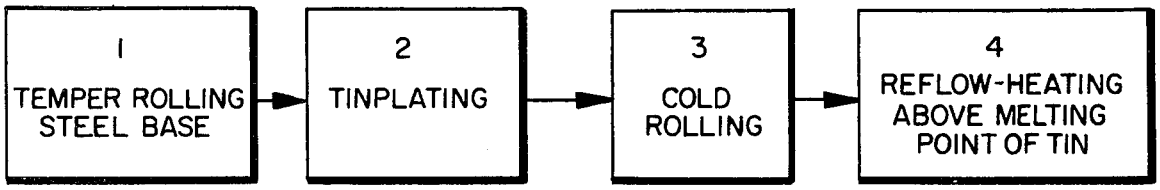
FIG. 5 is a flow diagram of the steps for producing an improved reflowed stock material by the mechanical and reflow method.

FIGS. 1 and 2 show the production of conventional matte and bright tinplate, and are self-explanatory. FIGS. 3, 4 and 5 show the inventive methods of producing an improved tinplated stock, those being the low thermal method, the low thermal and mechanical treatment method, and the mechanical and reflow method, respectively.

As shown in FIG. 3, in the low thermal method (so designated because its heating step temperature is lower than that used for producing bright finish stock) the steel sheet may be conventionally cold rolled or temper rolled to a reduction of thickness of, for example, up to 3% to provide a hard surface finish and proper temper, if desired. After temper rolling, a layer of tin is provided on at least one side of the steel base. The tin layer may be provided by any means; however, electrotinplating such as by conventional acid or alkaline electroplating is preferred. The tin coating may appear on both sides and may be of a tin coating weight of 0.25 to 0.35 pounds per base box as is presently typically used on stock for commmercially producing drawn and ironed beverage containers, or may be of lower or higher coating weights.

A third step of heating is then performed upon the stock. The heating step may be performed by any means. Induction heating, or resistance heating, which is used to produce bright finish tin by melting or reflowing the tin layer, is preferred since it allows a quick transfer of heat. However, in this aspect of my invention it is not desired that the tin layer be melted as is done in producing bright stock. The heating temperature may be as high as to be just below the melting point of tin layer (generally approximately 450° F.) and may be much lower, for example 250° F., and still form an alloy layer. The preferred range, however, is between 400° F. and the melting point of the tin layer since at these higher temperatures the desired alloy layer can be formed more quickly. It is understood that heating periods above the melting point of tin could be used, if heating cycles are shorter so that the tin does not reach a temperature which would in fact melt the tin.

The presence of the iron-tin alloy layer formed between the steel base and the plated tin layer is desirable since it increases the corrosion resistance of the stock. The alloy layer, however, is hard and brittle and is thought to decrease the formability of the stock. For example, matte finish tinplate having an extremely thin alloy layer which is only detectable by modern techniques has superior formability to bright finish tinplate having a larger alloy layer typically containing 20% to 50% of the plated tin's content.

It has been discovered, however, that when the alloy layer is formed to thinner thicknesses than as is formed during flow brightening by the heating below the melting point of tin, the formability of the stock is not only better than bright stock but surprisingly also better than matte finish stock.

Heating at commercially acceptable heating time cycles of 10 to 15 seconds by means of induction heating, it was found that at temperatures below the melting point of the tin layer produced stock with an alloy layer not so thick as to cause formability problems, and indeed increased formability was obtained. It is believed that heating for longer periods of time, especially at the upper temperatures of the range, will form alloy layers of a thickness which will reduce formability of the stock even if the tin is not melted. While the actual thickness limitation is not known, it has been found that stock produced by the low thermal and low thermal and mechanical methods may have thickness of up to 0.000003 inches and still have excellent formability.

It is believed that better formability of the thinner alloy layer is that it provides stronger adhesion between the steel base and the free tin. This better adhesion prevents a wipe-out of the alloy layer during the ironing step which would expose the steel to the ironing dies. The benefit of the stronger adhesion between the steel and free tin is believed to outweigh the disadvantages caused by the brittleness of the alloy layer as long as the thickness of the alloy layer does not become too great.

The nature of the formation of the alloy layer also is believed to play an important part in increased formability. The formation of the alloy layer by heating below the melting point of tin forms a stock having a surface finish more similar in appearance to that of the coarser matte stock rather than smooth, bright finish.

It is recalled that matte stock has higher formability than bright stock. One unproven explanation which has been offered for this characteristic is that the coarse surface grain structure of matte finish, as opposed to the smooth finish of bright stock, provides better retention of lubricants in the microscopic hills and valleys of its surface; and the retention of the lubricants aids in the forming of the containers. If this theory is valid then the relatively coarse surface finish caused by low thermal heating is significant.

In addition to the thickness of the alloy layer and the quality of the stock's surface finish, another possible theory is offered to explain the inventive stock material's increased formability. During electroplating, certain plating stress in the stock arises by the trapping of hydrogen gas under the stock's surface. The stress may be relieved by the heating of the stock to release the trapped gas. The relief of the plating stress may offer an explanation why the inventive stock exhibits better formability than matte, which is not heated (other than for drying) after the electroplating step in its production.

In another aspect of this invention, it was further discovered that the stock produced by the low thermal and mechanical treatment method has further enhanced the formability and corrosion resistance characteristics of the stock. As can be seen in FIG. 4, the low thermal and mechanical method is similar to the low thermal method shown in FIG. 3 but with the additional step of a second cold working, such as is done for temper rolling, taking place after plating but before heating. The only other difference between the two methods is that to prevent too great of a temper change it is suggested that only up to, for example a 2% reduction in thickness be accomplished by each of the cold rolling step employed under the method of FIG. 3, preferrably up to 3% reduction in thickness is made by the sole temper rolling step.

The purpose of the second cold working step is to increase the quality of the later formed alloy layer by providing nucleation or potential growth sites of higher quality than stock plate produced under the low thermal method of FIG. 3 and other prior art methods. One theory proposes that solid state reactions, such as a diffusion reaction under which the alloy layer is formed, more readily occur at locations of high potential energy or nucleation sites along the interface of the steel base and plated tin layer. Potential nucleation sites in polycrystalline metals such as steel and tin occur at locations having a higher potential energy relative to other locations. One area of high potential energy occurs at the boundaries between the grains of the metal. Since alloy layer formation occurs at the iron and tin layer interface, the grain boundaries located on the interface surfaces are of primary importance.

The plastic deformation during the second cold rolling causes slip line dislocations throughout the steel base and tin layer. The slip lines generally occur along paths from one surface of the layer to the opposite surface. For the tin layer, the paths are between the tin layer's outermost surface and opposite side of the layer interfacing with the steel base. The slip lines in the steel base occur along paths from the surface of steel base interfaced with the tin layer to the opposite surface of the steel base. This opposite surface will also be a steel-tin layer interface if both sides of the steel base are tinplated.

The termination of the slip lines at the interface surface creates what are referred to as edge dislocations.

It is noted at this time that a certain portion of the slip lines and edge dislocations occur in the steel base during the initial temper rolling and are further enhanced by the second rolling. More importantly, the second rolling provides edge dislocations in the tin layer. The second cold rolling is the only deformation of tin layer since it has not yet been deposited on the steel base at the time of the initial cold working.

The edge dislocations are areas of increased potential energy and add to the potential energy of the grain boundaries since the edge dislocations tend to occur most frequently at or adjacent the grain boundaries. Thus, the high energy nucleation sites produced promote the production of a better quality alloy layer during the later heating step. This higher quality alloy layer gives the stock its increased corrosion resistance and formability characteristics.

For accomplishing the second cold working step, cold rolling, as is employed in temper rolling, is preferred since such equipment is available and is presently used in the commercial production of tinplated stock. Any other suitable means, however, could be used to deform the tinplated stock to provide the edge dislocation discussed above. Also, working at a "cold" (room) temperature is not necessary except that it is preferred for the purpose of conserving energy.

EXAMPLES

The examples below show the results obtained from various formability and corrosion tests comparing matte, bright (formed under the method of FIG. 2), low thermal, and low thermal and mechanical stocks. The test samples were prepared from a single coil of 107 pound, 0.35 pound ETP X BAT-2 matte stock as received from a commercial supplier. Those samples designated as matte were directly taken from the coil while bright samples were prepared by baking the matte stock above 450° F. by the heating methods and time periods shown in the tables below. One exception exists in that the corrosion resistance test was run using commercial bright stock.

The low thermal stock and the low thermal and mechanical stock were also prepared from the matte stock with heating temperature, heating periods and method of heating as indicated in the tables. It is noted that for stock produced by the low thermal and mechanical treatment method the second cold working step provided approximately a 1% reduction in thickness.

Preparing the sample low thermal and low thermal and mechanical stock directly from matte stock demonstrates the inventive method's compatibility with present commercial methods of producing tinplate. Preferably, the stock would be commercially produced by the methods shown in FIGS. 3 or 4 since the heating steps therein eliminate the need to dry the stock after electrotinplating as is practiced in producing matte stock as shown in FIG. 1.

EXAMPLE 1—FRICTION TEST

To perform this test, a friction test machine as described in the *ASTM Special Technical Publication No.* 647, American Society for Testing and Materials, Philadelphia, PA 19103, 1978; was employed at a die pressure of 1400 pounds. The samples consisted of stock material approximately 2 inches wide and approximately 2 feet long. The friction of three sample strips of each stock material were tested in five locations on each strip. The results in Table I below show that the stock produced by the low thermal method was capable of a lower coefficient of friction (0.106) than matte (0.115) and bright (0.126).

TABLE I

| Friction Test | |
|---|---|
| Sample Tested | Coefficient of Friction |
| 1. Matte | .115 |
| 2. Bright (4 min., baked at over 450° F. by convection heat) | .125 |
| 3. Low Thermal (4 min., baked at over 300° F. to 350° F. by convection) | .106 |
| 4. Low Thermal and Mechanical (4 min., baked at 400° F. to 445° F. by convection) | .116 |

EXAMPLE II—FORCE MEASUREMENT

The force measurement test was performed on a Ragsdale bodymaker with measurements taken at the critical third ironing ring where maximum reduction, approximately 40%, in sidewall thickness occurs. Measurements were obtained through use of a strain gauge attached to the bodymaker measuring the force on the punch as it passed through the ironing rings. The average of exit and entrance forces were taken at the third ironing ring for about 15 to 20 cans made from each sample stock.

The data of Table II shows that the ironing of container stock produced by the low thermal method requires a significantly lesser amount of force as compared to both bright and matte finish stocks. Furthermore, the low thermal and mechanical treatment stock yielded force measurements which represent still an even much greater improvement over matte and bright stock.

TABLE II

| Force Measurements | |
|---|---|
| Sample Tested | Aver. Force in Pounds Third Ironing Die |
| 1. Matte | 3716 |
| 2. Bright (10 sec., baked at over 450° F. by induction heating) | 3803 |
| 3. Low Thermal (10 sec., baked at 350° F. by induction heating) | 3660 |
| 4. Low Thermal and Mechanical (10 sec., baked at 350° F. by induction heating) | 3388 |
| 5. Low Thermal and Mechanical (10 sec., baked at 400° F. by induction heating) | 3400 |

EXAMPLE III—STRIPPING FORCE MEASUREMENTS

As noted previously, the cupped stock is positioned on the punch of the bodymaker and forced through a series of dies to iron the cup to elongate its sidewall. After ironing, it is necessary to remove or strip the container from the punch of the bodymaker. On one such typical commercial bodymaker, stripping is accomplished by means of a "positive knockout" and a "garter stripper". The positive knockout is a mechanical member normally telescoped within the punch and which during stripping pushes against the interior surface of the container end wall to urge the container to slide off the punch. The garter stripper is a segmented annular gripping device which is inwardly spring biased. Near the end of the stroke of the punch, the punch and formed container thereon completely travel through the axially aligned annular opening of the stripper. At this time, the spring biased segmented grippers move to a position against and surrounding the punch. As the punch moves on its return stroke, the gripper engages the edges of the container at its open end to hold the container stationary as the punch is completely withdrawn from the container.

Stripping force measurements were taken for both the positive knockout and the garter stripper and were obtained by use of a strain gauge attached to the punch as noted above. While from the above description stripping may appear to be a relatively simple step, it in fact presents many potential problems and is considered a critical step in can making.

As indicated in Table III, the stripping forces were significantly better for both inventive methods (low thermal), and low thermal and mechanical treatment) when compared to matte or bright finish stock. It is noted that the low figure, 995 pounds, for the positive knockout of bright stock containers is misleading as an indication of good strippability. During garter stripping, a roll back, or splitting and roling back of the free edge, occurred, making the thus stripped bright stock cans unacceptable. The low thermal and low thermal and mechanical containers were successfully stripped without the occurrence of roll back or other defects.

TABLE III

| Stripping force Measurements | | |
|---|---|---|
| Sample Type | Positive Knockout (Force in pounds) | Garter Stripper (Force in pounds) |
| 1. Matte | 1364 | 1216 |
| 2. Bright (10 sec. baked at over 450° F. by induction heating) | 995 | 1320 |
| 3. Low Thermal (10 sec. baked at 350° F. by induction heating) | 1015 | 1072 |
| 4. Low Thermal & Mechanical (10 Sec. baked at 350° F. by induction heating) | 1068 | 1102 |
| 5. Low Thermal & Mechanical (10 sec. baked at 400° F. by induction heating) | 1115 | 1100 |

EXAMPLE IV—CORROSION RESISTANCE

Corrosion resistance tests were performed as described in U.S. Pat. No. 4,095,544, and commonly referred to as ACT tests. Three strips of each type of sample stock were tested. The test results in Table IV below are shown as polarization in millivolts with the higher polarization readings indicating higher corrosion resistance.

As expected, the bright finish stock exhibited the highest corrosion resistance, with matte finish stock being much lower. Sample No. 4 produced by the low thermal method provided stock with corrosion resistance which is a significant improvement over matte finish stock. While stock produced by the low thermal and mechanical method was not tested, it is believed that its corrosion resistance is a further improvement over low thermal stock. As stated previously, the second temper rolling step produces a more uniform and continuous alloy layer which better covers the steel base protecting it from corrosion.

TABLE IV

| Corrosion Resistance | |
|---|---|
| Sample Type | Polarization In Millivolts |
| 1. Matte | 320–327 |
| 2. Bright (commercial) | 479–528 |
| 3. Low Thermal (10 sec., baked at 300° F.–350° F. by induction heating) | 325–340 |
| 4. Low Thermal (10 sec., baked at 400° F.–445° F. by induction heating) | 394–417 |

In another aspect of this invention, the above described advantages of the second cold rolling step after tinplating are equally applicable to bright finish tinplate wherein the tinplated stock is heated to a temperature above the melting point of tin to form the alloy layer. The increased potential energy nucleation will also increase the quality of later formed alloy layer of the bright stock. In FIG. 5, such a method, designated as the mechanical and reflow method, is shown. The first three steps are identical to the low thermal and mechanical method of FIG. 4 thereby obtaining the benefit of the cold working step after tinplating to provide higher energy nucleation sites for forming a better quality alloy layer. In the method of FIG. 5, however, the fourth step of heating is at a temperature high enough to melt or flow brighten the tin, thus providing an improved bright finished stock.

While the improved bright stock may be used to produce drawn and ironed containers, it is also particularly applicable for making three-piece sanitary containers wherein corrosion resistance is of greater concern than formability.

Although only preferred embodiments of the invention have been specifically illustrated and described herein, it is to be understood that minor variations may be made in the methods without departing from the spirit and scope of the invention, as defined by the appended claims.

We claim:

1. A method of producing a seamless container body from tinplate stock material comprising the steps of:

a. providing a steel base stock material;
b. providing a layer of tin on at least one side of said steel base;
c. heating said stock with said layer of tin thereon to an elevated temperature above approximately 250° F., but lower than a temperature which is high enough to cause melting of said tin layer, to form an iron-tin alloy layer on said steel base; and
d. forming a seamless container body from said stock material after said heating.

2. A method of producing a container body from tinplated stock material comprising the steps of:

a. providing a steel base stock material;
b. providing a layer of tin on at least one side of said steel base;
c. cold rolling said steel base with said tin layer thereon;
d. heating said tinplated stock to an elevated temperature to form an iron-tin layer on said steel base; and
e. forming a container body from said stock.

3. The method of producing a stock material comprised of the steps of:

a. providing a steel base stock material;
b. providing a layer of tin on at least one side of said steel base;
c. rolling said steel base with said layer of tin thereon; and
d. heating said stock to an elevated temperature to form an iron-tin alloy layer.

4. The methods of claims 2 or 3 further characterized by said elevated temperature being above 250° F. but lower than a temperature high enough to cause melting of said tin.

5. The methods of claims 1, or 2, or 3 further characterized by said elevated temperature being above approximately 400° F. but lower than a temperature which is high enough to cause melting of said tin.

6. The method of claims 2 or 3 further characterized by said heating step being at a temperature high enough to cause melting of said tin.

7. The methods of claims 1, or 2, or 3 further characterized by said heating step forming an iron-tin alloy layer which is less than approximately 0.000003 inches thick.

8. The methods of claims 1, or 2, or 3 further characterized by said method having a step of temper rolling said steel base, said temper rolling occurring before said step of providing a layer of tin.

9. The method of claims 2 or 3 further characterized by said rolling step compressing said stock to up to approximately a 2% reduction in thickness.

10. The methods of claims 1, 2 and 3 further characterized by said step of providing a layer of tin comprising electrotinplating.

11. The method of claim 2 further characterized by said container body being seamless.

* * * * *